US007537488B2

(12) United States Patent
Iwakawa

(10) Patent No.: US 7,537,488 B2
(45) Date of Patent: May 26, 2009

(54) COMMUNICATION CABLE CONNECTOR AND COMMUNICATION CABLE

(75) Inventor: Shunichi Iwakawa, Kanagawa (JP)

(73) Assignee: NEC Electronics Corporation, Kanagawa (JP)

( * ) Notice: Subject to any disclaimer, the term of this patent is extended or adjusted under 35 U.S.C. 154(b) by 0 days.

(21) Appl. No.: 11/524,883

(22) Filed: Sep. 22, 2006

(65) Prior Publication Data

US 2007/0077818 A1 Apr. 5, 2007

(30) Foreign Application Priority Data

Oct. 3, 2005 (JP) ..... 2005-289634

(51) Int. Cl.
*H01R 24/00* (2006.01)

(52) U.S. Cl. ..... 439/660

(58) Field of Classification Search ..... 439/660, 439/101, 289, 284

See application file for complete search history.

(56) References Cited

U.S. PATENT DOCUMENTS 4,289,366 A * 9/1981 Marks ..... 439/293
6,179,629 B1 * 1/2001 Lai et al. ..... 439/79
6,296,521 B1 10/2001 Chang et al.
6,375,512 B1 * 4/2002 Zito et al. ..... 439/660
6,383,023 B1 5/2002 Chang et al.
7,165,998 B2 * 1/2007 Lee et al. ..... 439/660
7,182,646 B1 * 2/2007 Chou et al. ..... 439/660

FOREIGN PATENT DOCUMENTS

JP 2003-197302 7/2003
JP 2003-197318 7/2003

* cited by examiner

*Primary Examiner*—Phuong K Dinh
(74) *Attorney, Agent, or Firm*—Foley & Lardner LLP

(57) ABSTRACT

A connector of a communication cable includes a pair of power supply terminals disposed on a first surface inside a metal shield, a pair of signal terminals disposed on the first surface or a second surface different from the first surface inside the metal shield, and additional terminals for power supply or signal input/output. If the signal terminals are disposed on the first surface, the additional terminals are disposed on a surface different from the first surface. If the signal terminal is disposed on the second surface, the additional terminals are disposed on the first surface, the second surface, or a surface different from the first surface and the second surface.

13 Claims, 11 Drawing Sheets

Related Art

Related Art

COMMUNICATION CABLE CONNECTOR AND COMMUNICATION CABLE

BACKGROUND OF THE INVENTION

1. Field of the Invention

The present invention relates to a connector of a communication cable and a communication cable and particularly to a plug connector of a communication cable and a receptacle connector which are specified by a data communication standard such as Universal Serial Bus (USB).

2. Description of Related Art

As main equipment with a built-in computer become highly functional, peripheral equipment such as a printer, an input device and a hard disk drive (HDD) become more functional accordingly. A computer and peripheral equipment are connected through a communication cable or the like according to a prescribed communication standard. Though various communication standards have been proposed and used, peripheral equipment connection based on the USB standard is widely used recently.

The USB standard defines two types: A type plug connector and receptacle connector, and B type plug connector and receptacle connector.

In the following description, a plug connector and a receptacle connector are referred to collectively as a "connector" where they are not distinguished, and referred to simply as a "plug" and a "receptacle" respectively, where distinguished. Further, where the two different types of connectors are distinguished, they are abbreviated as "A-" and "B-" such as an A-connector and a B-plug.

In the USB standard, a conventional A-plug 901 shown in FIG. 16 corresponds with a conventional A-receptacle 902 shown in FIG. 17. The A-plug 901 is inserted into the A-receptacle 902, so that terminals 911 to 914 and terminals 921 to 924, which are respectively placed in the A-plug 901 and the A-receptacle 902, are electrically connected to each other. Further, a conventional B-plug 903 shown in FIG. 18 corresponds with a conventional B-receptacle 904 shown in FIG. 19. The B-plug 903 is inserted into the B-receptacle 904, so that terminals 931 to 934 and terminals 941 to 944, which are respectively placed in the B-plug 903 and the B-receptacle 904, are electrically connected to each other.

When connecting equipment which requires high power consumption, such a conventional connector of a communication cable is mated with a power cable or a battery rather than a communication cable to thereby increase power supply using a different means from a communication cable. Therefore, for equipment which cannot be connected with a different means from a communication cable, power supply is limited.

Further, for equipment which communicates with non-USB standard, it is necessary to use a different means from a standardized communication cable. Therefore, equipment which cannot be connected with the different communication means may be incapable of communication.

To overcome such drawbacks, a connector of a communication cable for additional power transmission is disclosed in Japanese Unexamined Patent Application Publication Nos. 2003-197318 and 2003-197302, for example. Those techniques provides an additional power supply terminal on an insulating resin where power supply terminals and signal terminals are formed, thereby enabling additional power transmission.

Because the shape and position of an existing terminal are defined by the standard, it is difficult to add a new terminal due to space limitation. Further, if there are connectors and receptacles having additional power supply terminals in which a power supply terminal and a GND terminal has the same shape with reverse polarity, for example, wrong insertion is likely to occur to cause short-circuit or failure in appropriate signal transmission.

As described in the foregoing, a conventional communication cable is incompatible with the transmission of additional power supply, a signal outside of the USB standard, and so on.

SUMMARY OF THE INVENTION

According to an aspect of the present invention, there is provided a connector of a communication cable including a pair of power supply terminals disposed on a first surface inside a main body, a pair of signal terminals disposed on the first surface or a second surface different from the first surface inside the main body, and an additional terminal for power supply or signal input/output, the additional terminal disposed on a surface different from the first surface if the signal terminals are disposed on the first surface, and disposed on one of the first surface, the second surface, and a surface different from the first surface and the second surface if the signal terminals are disposed on the second surface.

According to another aspect of the present invention, there is provided a plug connector of a communication cable to fit with a receptacle connector of a communication cable for establishing a connection, including a protrusion to fit into the receptacle connector, a receptor to receive the receptacle connector, a power supply terminal disposed on a surface of the protrusion and exposed at the surface, a signal terminal disposed on a surface of the protrusion and exposed at the surface, and a first additional terminal exposed partly at an end surface of the protrusion and/or a second additional terminal exposed partly at a rear-end surface of the receptor.

According to another aspect of the present invention, there is provided a plug connector of a communication cable to fit with a receptacle connector of a communication cable for establishing a connection, including a cavity for receiving a protrusion of the receptacle connector, a power supply terminal disposed on an inner surface of the cavity and exposed at the inner surface, a signal terminal disposed on an opposite surface to the inner surface having the power supply terminal and exposed at the opposite surface, and a first additional terminal exposed at the inner surface of the cavity and/or a second additional terminal exposed at an outer surface of the cavity.

According to another aspect of the present invention, there is provided a receptacle connector of a communication cable to fit with a plug connector of a communication cable for establishing a connection, including a protrusion to fit into the plug connector, a receptor to receive the plug connector, a power supply terminal disposed on a surface of the protrusion and exposed at the surface, a signal terminal disposed on a surface of the protrusion and exposed at the surface, and a first additional terminal exposed partly at an end surface of the protrusion and/or a second additional terminal exposed partly at a rear-end surface of the receptor.

According to another aspect of the present invention, there is provided a receptacle connector of a communication cable to fit with a plug connector of a communication cable for establishing a connection, including a cavity for receiving a protrusion of the plug connector, a protrusion disposed in the cavity for receiving a cavity of the plug connector, a power supply terminal disposed on an outer surface of the protrusion and exposed at the outer surface, a signal terminal disposed on an opposite surface to the outer surface having the power supply terminal and exposed at the opposite surface, and a first additional terminal exposed at the outer surface of the protrusion and/or a second additional terminal exposed at an inner surface of the cavity.

BRIEF DESCRIPTION OF THE DRAWINGS

The above and other objects, advantages and features of the present invention will be more apparent from the following description taken in conjunction with the accompanying drawings, in which.

DESCRIPTION OF THE PREFERRED EMBODIMENTS

The invention will be now described herein with reference to illustrative embodiments. Those skilled in the art will recognize that many alternative embodiments can be accomplished using the teachings of the present invention and that the invention is not limited to the embodiments illustrated for explanatory purposed.

A connector according to the present invention has a power supply terminal and a signal terminal as specified by a USB standard and an additional terminal provided on a different surface from the surface on which the power supply terminal and the signal terminal as specified by a USB standard are formed.

Preferred embodiments of the present invention are described hereinafter with reference to the drawings.

First Embodiment

In a first exemplary embodiment, the present invention is applied to an A-connector.

Figure 1:
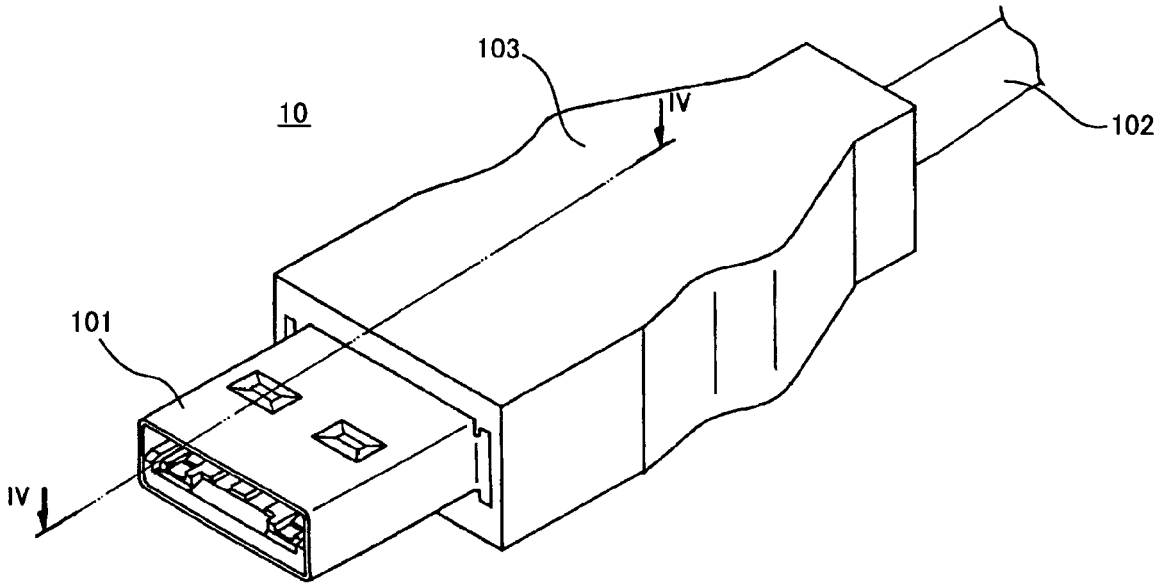
FIG. 1 is a perspective view of an exemplary A-plug according to an embodiment of the present invention.

Referring first to FIG. 1, a schematic structure of an A-plug according to this embodiment is described. FIG. 1 is a perspective view showing the external appearance of an A-plug according to this embodiment. As shown in FIG. 1, an A-plug 10 includes a main body 101, a communication cable 102, and a housing 103.

The main body 101 is the part into which an A-receptacle, which is described later, is inserted. The main body 101 contains power supply terminals and signal terminals. The communication cable 102 is electrically connected to the main body 101. The housing 103 shields the main body 101 from outside influences and protects a connection between the main body 101 and the communication cable 102.

Figure 2:
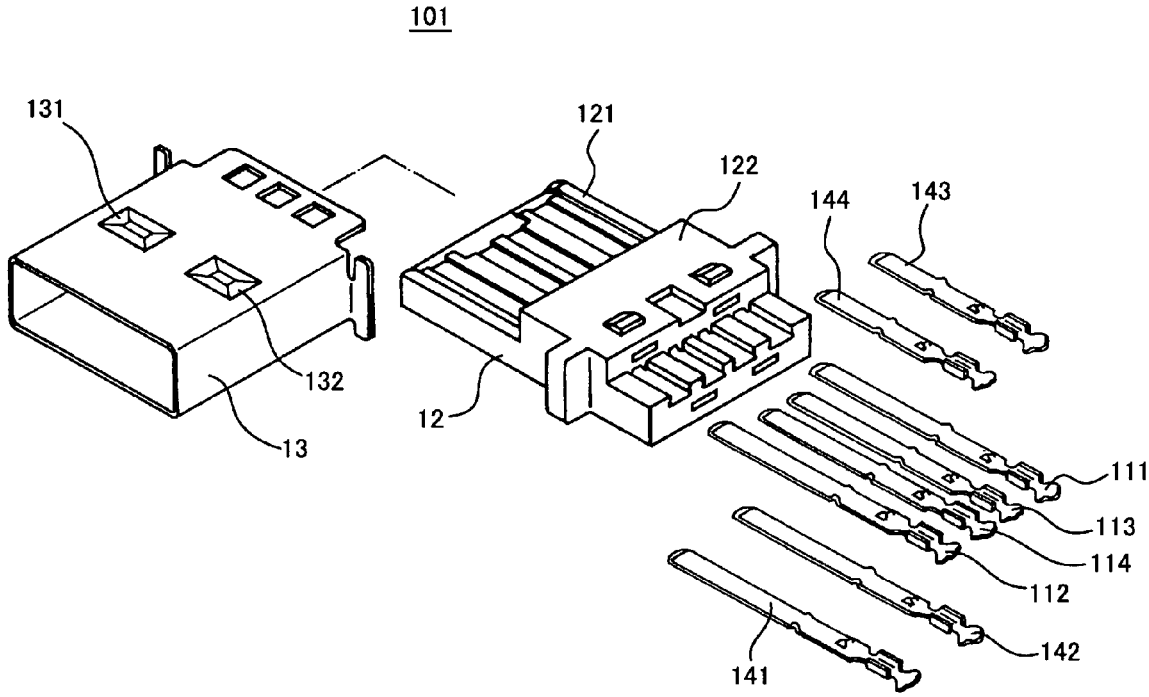
FIG. 2 is an exploded perspective view of an exemplary A-plug according to an embodiment of the present invention.
Figure 3:
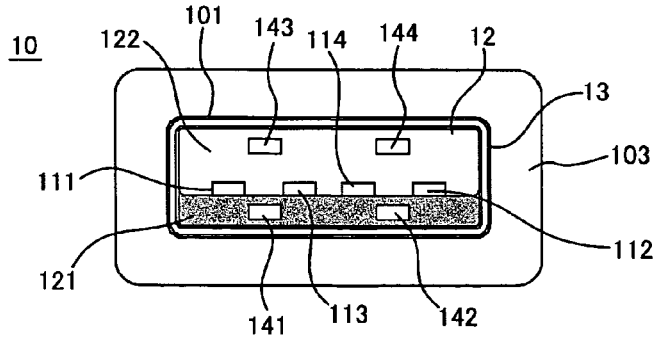
FIG. 3 is a front view of an exemplary A-plug according to an embodiment of the present invention.
Figure 4:
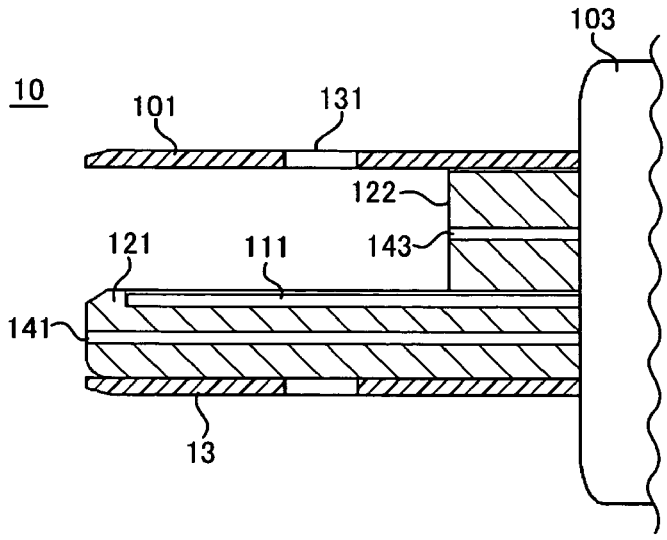
FIG. 4 is a sectional view of an exemplary A-plug according to an embodiment of the present invention.

Referring next to FIGS. 2 to 4, the A-plug 10 of this embodiment is described in detail hereinbelow.

The exploded perspective view of FIG. 2 shows the main body 101 of the A-plug 10. As shown in FIG. 2, the main body 101 of the A-plug 10 includes power supply terminals 111 and 112, signal terminals 113 and 114, an insulating resin portion 12, and a metal shield 13. In addition to those components which are specified by a normal USB standard, the A-plug 10 of this embodiment further includes additional terminals 141, 142, 143 and 144.

The power supply terminals 111 and 112 are a terminal pair for establishing electrical connection with power supply terminals of an A-receptacle, described later, and providing power supply. The signal terminals 113 and 114 are a terminal pair for establishing electrical connection with signal terminals of the A-receptacle and inputting/outputting signals.

The insulating resin portion 12 is formed of an insulating resin and has a raised-shape cross section. The insulating resin portion 12 includes a protrusion 121 and a receptor 122. The protrusion 121 is inserted into the A-receptacle when the A-plug 10 is mated with the A-receptacle. The receptor 122 receives a protrusion of the A-receptacle at this time. The protrusion 121 protrudes to the front compared with the receptor 122. The front refers to the direction to insert the A-plug 10 into the A-receptacle. Thus, the front is an opposite direction from the direction to which the communication cable 102 extends.

The metal shield 13 is a frame to cover the main body 101 and contains the terminals 111 to 114 and 141 to 144, and the insulating resin portion 12. The top surface of the metal shield 13 has hollows 131 and 132 for maintaining the mated condition with the A-receptacle. Though not shown, the bottom surface of the metal shield 13 also has two hollows similar to the hollows 131 and 132.

The additional terminals 141 to 144 may function as power supply terminals and signal terminals according to need. For example, the additional terminals 141 to 144 are used for inputting and outputting power supply control signals and low-speed data control signals. Specifically, the additional terminals 141 to 144 is used for input/output of the signals for detecting a connection condition between the A-plug 10 and the A-receptacle, and input/output of the signals for controlling a annunciation means such as LED for indicating an attach/detach condition.

FIG. 3 illustrates a front view of the A-plug 10, and FIG. 4 illustrates a cross-sectional view along line IV-IV in FIG. 1. As shown in FIG. 3, the terminals 111 to 114 are attached to the insulating resin portion 12 in such a way that the top surface at both ends of each terminal is exposed. Specifically, the terminals 111 to 114 are disposed on the top surface of the protrusion 121 of the insulating resin portion 12 and covered with the receptor 122 for fixation. The both ends of the terminals 111 to 114 are thereby exposed at both sides of the receptor 122. The front-side exposed portions of the terminals 111 to 114 are connected to terminals of the A-receptacle to establish electrical connection. The back-side exposed portions of the terminals 111 to 114 are fixed to the communication cable 102.

The additional terminals 141 and 142 are also attached to the insulating resin portion 12. As shown in FIG. 4, the terminals 141 and 142 are covered with the receptor 122 for fixation, and their ends are exposed at the side surface (the end surface at the front) of the protrusion 121. Specifically, these ends are exposed at the front of the protrusion 121 and connected to additional terminals which are disposed in the A-receptacle to establish electrical connection. The other ends of the additional terminals 141 and 142 projects backward, and the back-side exposed portions are fixed to the communication cable 102.

The additional terminals 143 and 144 are also attached to the insulating resin portion 12 but attached to the receptor 122 unlike the additional terminals 141 and 142. As shown in FIG. 4, the additional terminals 143 and 144 are covered with the receptor 122 for fixation, and their ends are exposed at the side surface (the rear-end surface at the bottom) of the receptor 122. Specifically, these ends are exposed at the front of the receptor 122 which is recessed inside the insulating resin portion 12 and connected to additional terminals which are disposed in the A-receptacle to establish electrical connection. The other ends of the additional terminals 143 and 144 projects backward, and the back-side exposed portions are fixed to the communication cable 102.

Figure 5:
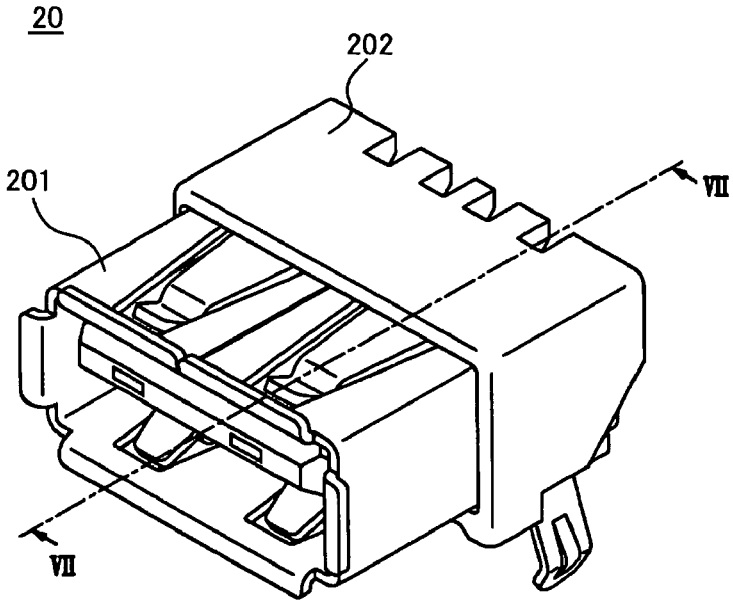
FIG. 5 is a perspective view of an exemplary A-receptacle according to an embodiment of the present invention.

Referring then to FIG. 5, a schematic structure of an A-receptacle according to this embodiment is described. FIG. 5 is a perspective view showing the external appearance of an A-receptacle according to this embodiment. As shown in FIG. 5, an A-receptacle 20 includes a main body 201 and a housing 202.

The main body 201 is the part into which the A-plug 10 is inserted. The main body 201 contains power supply terminals and signal terminals. The housing 202 shields the main body 201 from outside influences and protects a connection between the A-plug 10 and the main body 201.

Figure 6:
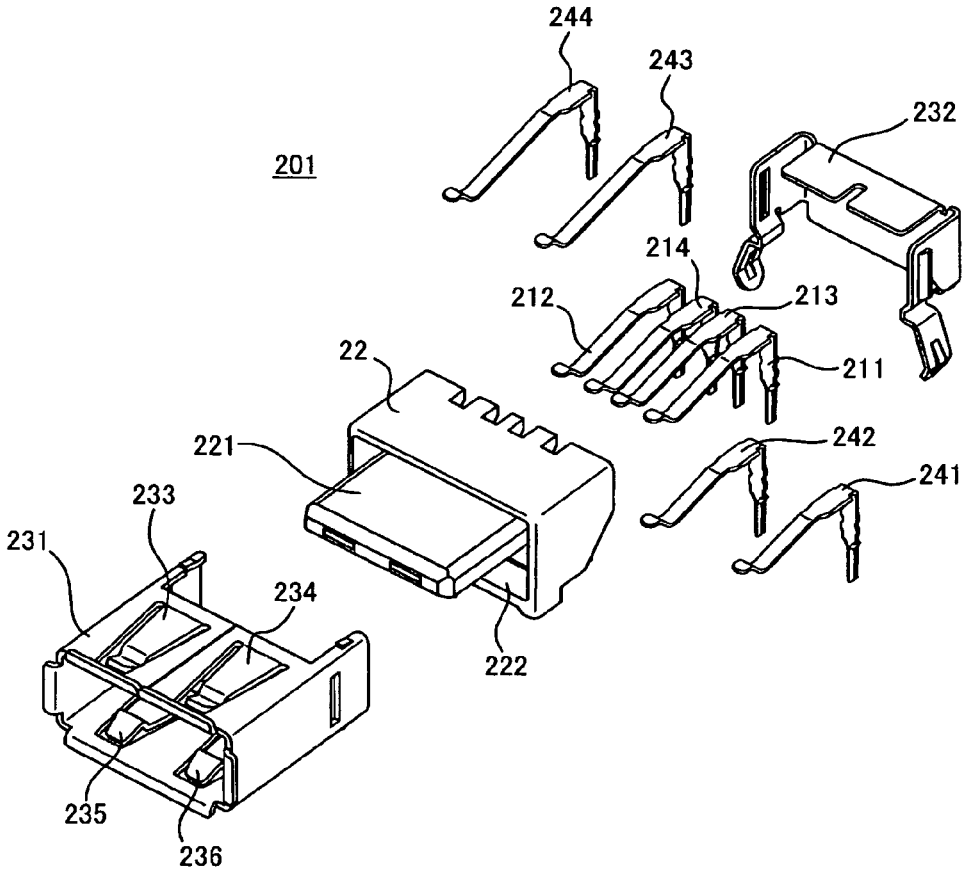
FIG. 6 is an exploded perspective view of an exemplary A-receptacle according to an embodiment of the present invention.
Figure 7:
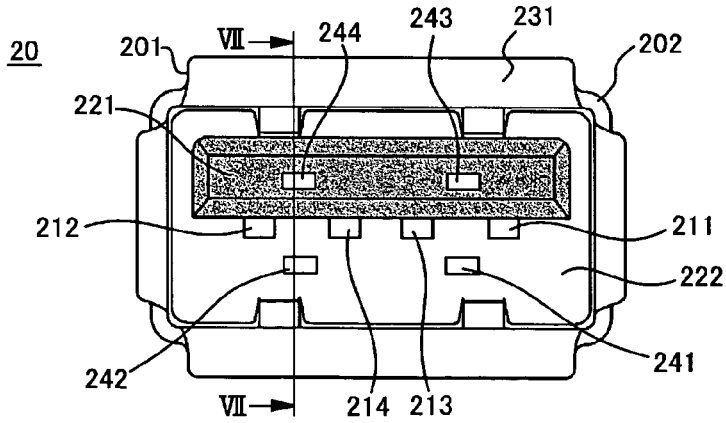
FIG. 7 is a front view of an exemplary A-receptacle according to an embodiment of the present invention.
Figure 8:
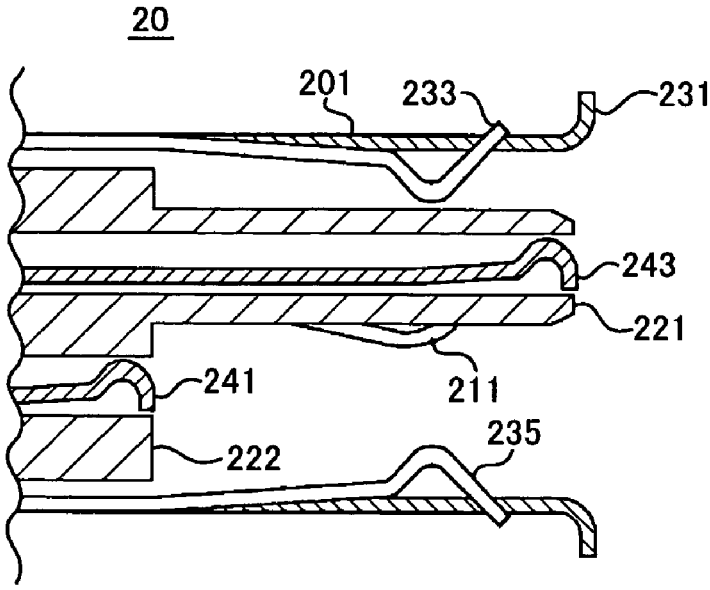
FIG. 8 is a sectional view of an exemplary A-receptacle according to an embodiment of the present invention.

Referring next to FIGS. 6 to 8, the A-receptacle 20 of this embodiment is described in detail hereinbelow.

The exploded perspective view of FIG. 6 shows the main body 201 of the A-receptacle 20. As shown in FIG. 6, the main body 201 of the A-receptacle 20 includes power supply terminals 211 and 212, signal terminals 213 and 214, an insulating resin portion 22, and metal shields 231 and 232. In addition to those components which are specified by a normal USB standard, the A-receptacle 20 of this embodiment further includes additional terminals 241, 242, 243 and 244.

The power supply terminals 211 and 212 are a terminal pair for establishing electrical connection with the power supply terminals 111 and 112 of the A-plug 10 and providing power supply. The signal terminals 213 and 214 are a terminal pair for establishing electrical connection with the signal terminals 113 and 114 of the A-plug 10 and inputting/outputting signals. The terminals 211 to 214 have a flexible structure such as a spring pin.

The insulating resin portion 22 includes a protrusion 221 and a receptor 222. The protrusion 221 is inserted into the receptor 122 of the A-plug 10 when the A-plug 10 is mated with the A-receptacle 20. The receptor 222 receives protrusion 121 of the A-plug 10 at this time. The protrusion 221 protrudes to the front compared with the receptor 222. The front refers to the direction in which A-plug 10 is attached when the A-plug 10 is inserted into the A-receptacle 20. Thus, the front is the direction to face the A-plug 10.

The metal shield 231 is a frame to cover the protrusion 221 of the insulating resin portion 22 and contains the terminals 211 to 214 and 241 to 244. The metal shield 232 is a frame to fix the insulating resin portion 22 to the metal shield 231. The top surface of the metal shield 231 has projections 233 and 234 for maintaining the mated condition with the A-plug 10. The bottom surface of the metal shield 231 also has the projections 235 and 236.

The additional terminals 241 to 244 may function as power supply terminals and signal terminals according to need, just like the additional terminals 141 to 144 of the A-plug 10. Although the additional terminals 141 to 144 of the A-plug 10 have a flat shape, the additional terminals 241 to 244 have a flexible structure such as a spring pin just like the terminals 211 to 214.

FIG. 7 illustrates a front view of the A-receptacle 20, and FIG. 8 illustrates a cross-sectional view along line VII-VII in FIG. 5. As shown in FIG. 7, the terminals 211 to 214 are attached to the insulating resin portion 22 in such a way that the both ends of each terminal are exposed. Specifically, the terminals 211 to 214 are disposed on the bottom surface of the protrusion 221 of the insulating resin portion 22 and covered with the receptor 222 for fixation. The both ends of the terminals 211 to 214 are thereby exposed at both sides of the receptor 222. The front-side exposed portions of the terminals 211 to 214 are connected to the terminals 111 to 114 of the A-plug 10 to establish electrical connection. The back-side exposed portions of the terminals 211 to 214 bend downward to be connected with equipment.

The additional terminals 241 and 242 are also attached to the insulating resin portion 22. As shown in FIG. 8, the terminals 241 and 242 are covered with the receptor 222 for fixation, and their ends are exposed at the side surface (the rear-end surface at the bottom) of the receptor 222. Specifically, these ends are exposed at the front of the receptor 222 which is recessed inside the insulating resin portion 22 and connected to the additional terminals 141 and 142 of the A-plug 10 to establish electrical connection. The other ends of the additional terminals 241 and 242 projects downward, and the down-side exposed portions are fixed to an equipment main body.

The additional terminals 243 and 244 are also attached to the insulating resin portion 22 but attached to the protrusion 221 unlike the additional terminals 241 and 242. As shown in FIG. 8, the additional terminals 243 and 244 are covered with the protrusion 221 for fixation, and their ends are exposed at the side surface (the end surface at the front) of the protrusion 221. Specifically, these ends are exposed at the front of the protrusion 221 and connected to the additional terminals 143 and 144 of the A-plug 10 to establish electrical connection.

The other ends of the additional terminals 243 and 244 projects downward, and the down-side exposed portions are fixed to an equipment main body.

Figure 9:
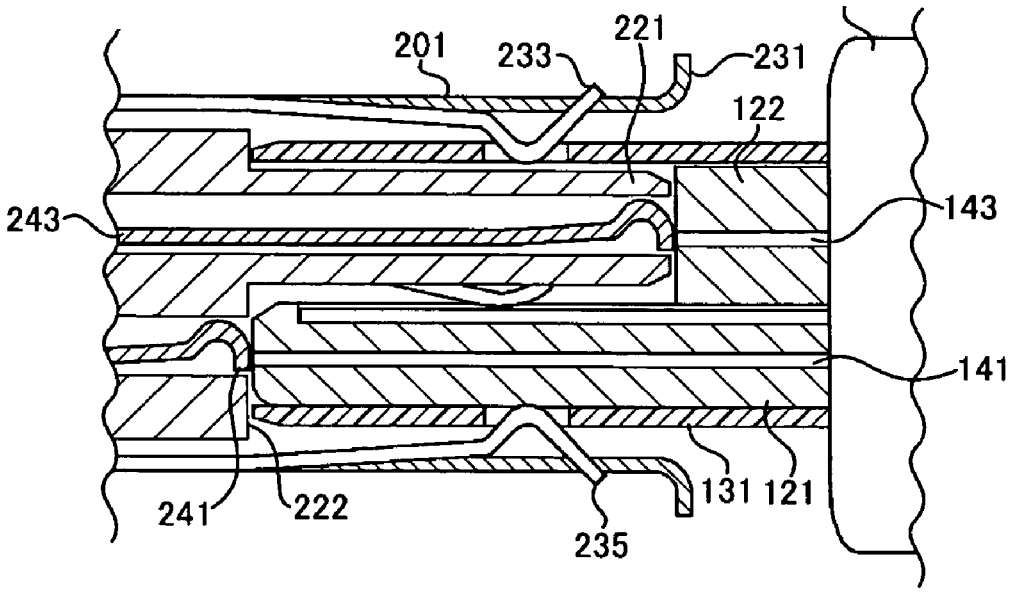
FIG. 9 is a sectional view of an exemplary A-plug and an exemplary A-receptacle according to an embodiment of the present invention.

FIG. 9 illustrates the state where the A-plug 10 is inserted into the A-receptacle 20.

As shown in FIG. 9, when the A-plug 10 is inserted into the A-receptacle 20, the bottom of the four (upper and lower) hollows in the metal shield 13 of the A-plug 10 fit with the four (upper and lower) projections 233 to 236 in the metal shield 231 of the A-receptacle 20. The metal shield 13 is thereby latched with the metal shield 231, so that the A-plug 10 and the A-receptacle 20 are fixed with each other.

The protrusion 121 of the A-plug 10 is inserted between the receptor 222 and the metal shield 231 of the A-receptacle 20. The side surface of the protrusion 121 and the side surface of the receptor 222 face each other, and the additional terminals 141 and 142 on the protrusion 121 side are respectively in contact with the additional terminals 241 and 242 on the receptor 222 side at this condition. The additional terminals 241 and 242 are flexible, and the A-plug 10 and the A-receptacle 20 are fixed with each other. Therefore, the repulsive force from the additional terminals 241 and 242 keeps the additional terminals 141 and 142 and the additional terminals 241 and 242 respectively in contact with each other.

The protrusion 221 of the A-receptacle 20 is also inserted between the receptor 122 and the metal shield 13 of the A-plug 10. The side surface of the protrusion 221 and the side surface of the receptor 122 face each other, and the additional terminals 143 and 144 and the additional terminals 243 and 244 at both sides of the facing surfaces are respectively in contact with each other. The additional terminals 143 and 144 are pressed against the additional terminals 243 and 244, and the repulsive force from the additional terminals 243 and 244 keeps the additional terminals 143 and 144 and the additional terminals 243 and 244 respectively in contact with each other.

As described in the foregoing, the A-plug 10 and the A-receptacle 20 of this embodiment respectively have the additional terminals 141 to 144 and 241 to 244 in addition to the terminals 111 to 114 and 211 to 214 which are typically specified by the USB standard. Thus, if the additional terminals 141 to 144 and 241 to 244 are used as power supply terminals, it is possible to provide additional power supply.

The additional terminals 141 to 144 and 241 to 244 are disposed on the different surface from the surface on which the standardized terminals 111 to 114 and 211 to 214 are disposed. This enables effective use of the surfaces of the A-plug 10 and the A-receptacle 20.

Second Embodiment

In a second exemplary embodiment, the present invention is applied to a B-connector.

Figure 10:
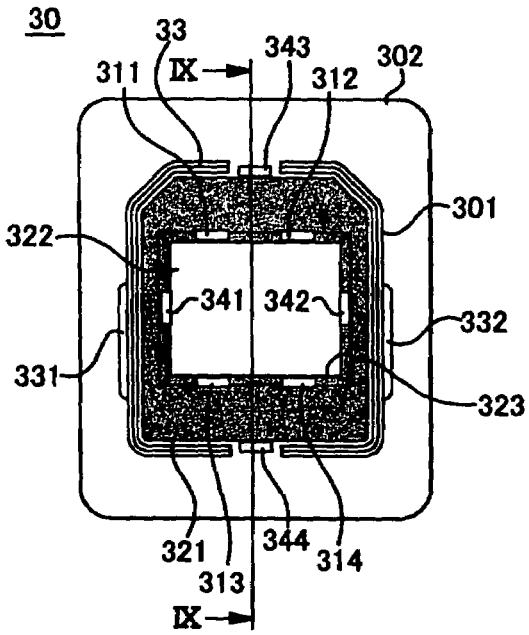
FIG. 10 is a front view of an exemplary B-plug according to an embodiment of the present invention.
Figure 11:
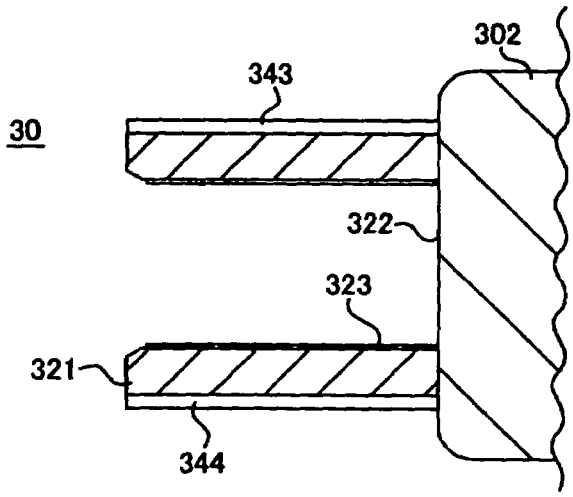
FIG. 11 is a sectional view of an exemplary B-plug according to an embodiment of the present invention.

Referring to FIGS. 10 and 11, a B-plug 30 according to the second embodiment is described hereinafter.

FIG. 10 illustrates a front view of the B-plug 30 according to the second embodiment. The front refers to the direction to insert a B-plug into a B-receptacle. Thus, the front is an opposite direction from the direction to which a communication cable extends.

As shown in FIG. 10, the B-plug 30 of the second embodiment includes a main body 301 and a housing 302 just like the A-plug 10. A communication cable connected to the B-plug 30 is not illustrated in FIG. 10.

As shown in FIG. 10, the main body 301 of the B-plug 30 includes power supply terminals 311 and 312, signal terminals 313 and 314, an insulating resin portion 32, and a metal shield 33. In addition to those components which are specified by a normal USB standard, the B-plug 30 of this embodiment further includes additional terminals 341, 342, 343 and 344. The detailed description of the components of the B-plug 30 which are specified by the USB standard is omitted herein.

The insulating resin portion 32 includes a protrusion 321 and a receptor 322 just like in the A-plug 10. The protrusion 321 surrounds the receptor 322. The receptor 322 is placed at the middle of the protrusion 321, so that a cavity 323 is created above the receptor 322. The left and right side surfaces of the metal shield 33 have projections 331 and 332 for keeping the mated condition with a B-receptacle.

The additional terminals 341 to 344 may function as power supply terminals and signal terminals according to need, just like the additional terminals 141 to 144 of the A-plug 10.

FIG. 11 illustrates a cross section along line XI-XI in FIG. 10.

As shown in FIG. 10, the terminals 311 to 314 are attached to the protrusion 321 of the insulating resin portion 32 and exposed to the cavity 323. Specifically, the terminals 311 to 314 are disposed on the upper and lower inner surfaces of the protrusion 321 so that they face each other through the cavity 323.

The additional terminals 341 and 342 are also attached to the protrusion 321 of the insulating resin portion 32. The additional terminals 341 and 342 also face each other through the cavity 323 and are exposed to the cavity 323. Thus, the additional terminals 341 and 342 are exposed to the inner side of the protrusion 321.

The additional terminals 341 and 342 are attached to the left and right inner surfaces of the protrusion 321 as described above. On the other hand, the additional terminals 343 and 344 are attached to the outer surfaces of the protrusion 321 and are exposed to the outer side of the cavity 323.

Figure 12:
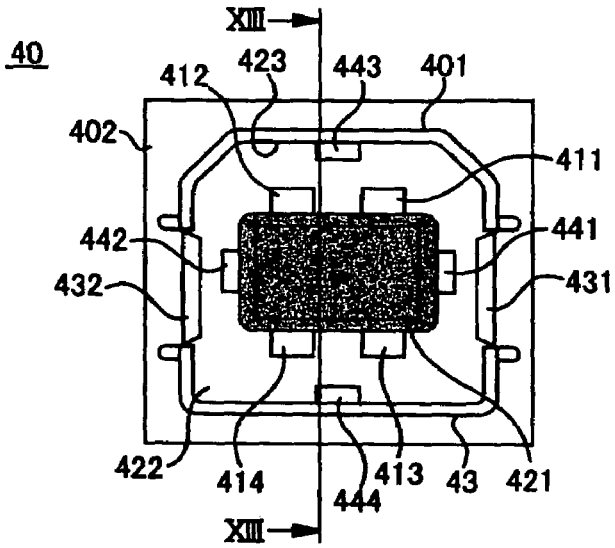
FIG. 12 is a front view of an exemplary B-receptacle according to an embodiment of the present invention.
Figure 13:
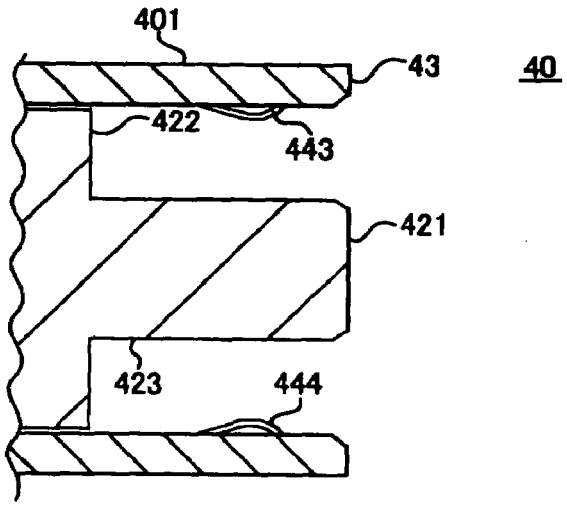
FIG. 13 is a sectional view of an exemplary B-receptacle according to an embodiment of the present invention.

Referring then to FIGS. 12 and 13, a B-receptacle 40 according to the second embodiment is described hereinafter.

FIG. 12 illustrates a front view of the B-receptacle 40 according to the second embodiment. The front refers to the direction to insert a B-plug into a B-receptacle. Thus, the front is the direction to face the B-plug 30.

As shown in FIG. 12, the B-receptacle 40 of the second embodiment includes a main body 401 and a housing 402.

As shown in FIG. 12, the main body 401 of the B-receptacle 40 includes power supply terminals 411 and 412, signal terminals 413 and 414, an insulating resin portion 42, and a metal shields 43. In addition to those components which are specified by a normal USB standard, the B-receptacle 40 of this embodiment further includes additional terminals 441, 442, 443 and 444. The detailed description of the components of the B-receptacle 40 which are specified by the USB standard is omitted herein.

The insulating resin portion 42 includes a protrusion 421 and a receptor 422 just like in the A-receptacle 20. The protrusion 421 is placed at the middle of the receptor 422. The receptor 422 surrounds the protrusion 421, so that a cavity 423 is created in the vicinity of the protrusion 421. The left and right side surfaces of the metal shield 43 have holding members 431 and 432 for keeping the mated condition with the B-plug 30.

The additional terminals 441 to 444 may function as power supply terminals and signal terminals according to need, just like the additional terminals 241 to 244 of the A-receptacle 20.

FIG. 13 illustrates a cross section along line XIII-XIII in FIG. 12.

As shown in FIG. 13, the terminals 411 to 414 are attached to the protrusion 421 of the insulating resin portion 42 and exposed to the cavity 423. Specifically, the terminals 411 to 414 are disposed on the upper and lower outer surfaces of the protrusion 421 so that they face each other through the protrusion 421.

The additional terminals 441 and 442 are also attached to the protrusion 421 of the insulating resin portion 42. The additional terminals 441 and 442 also face each other through the protrusion 421 and are exposed to the cavity 423.

The additional terminals 441 and 442 are attached to the left and right outer surfaces of the protrusion 421. On the other hand, the additional terminals 443 and 444 are attached to the upper and lower inner surfaces of the cavity 423 and are exposed inside the cavity 423.

Figure 14:
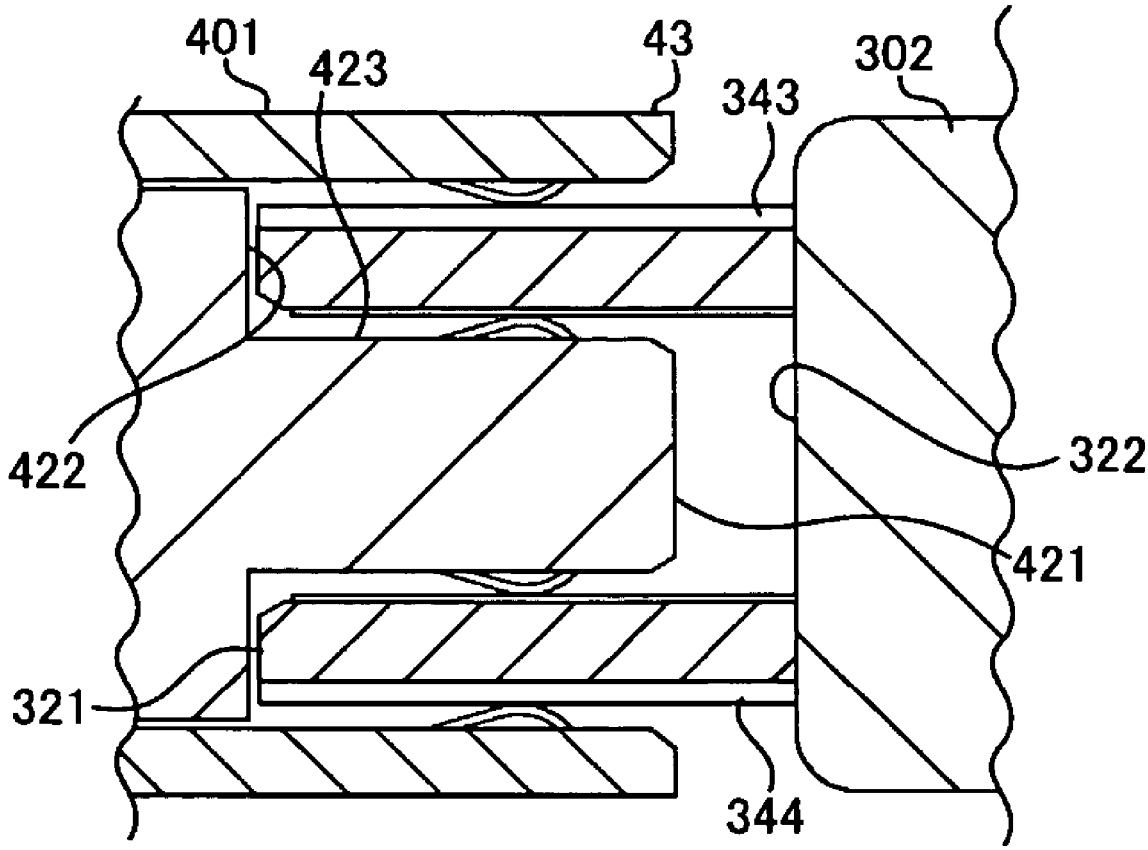
FIG. 14 is a sectional view of an exemplary B-plug and an exemplary B-receptacle according to an embodiment of the present invention.

FIG. 14 illustrates the state where the B-plug 30 is inserted into the B-receptacle 40.

As shown in FIG. 14, when the B-plug 30 is inserted into the B-receptacle 40, the two (left and right) holding members 431 and 432 in the metal shield 43 of the B-receptacle 40 fit with the two (left and right) projections 331 and 332 in the metal shield 33 of the B-plug 30. The metal shield 43 is thereby latched with the metal shield 33, so that the B-plug 30 and the B-receptacle 40 are fixed with each other.

The protrusion 421 of the B-receptacle 40 is inserted between the receptor 322 and the metal shield 33 of the B-plug 30. The side surface of the protrusion 421 and the side surface of the receptor 322 face each other, and the additional terminals 441 and 442 on the protrusion 421 side are respectively in contact with the additional terminals 341 and 342 on the receptor 322 side at this condition. The additional terminals 341 and 342 are flexible, and the B-receptacle 40 and the B-plug 30 are fixed with each other. Therefore, the repulsive force from the additional terminals 441 and 442 keeps the additional terminals 341 and 342 and the additional terminals 441 and 442 respectively in contact with each other.

The protrusion 321 of the B-plug 30 is also inserted between the receptor 422 and the metal shield 43 of the B-receptacle 40. The side surface of the protrusion 321 and the side surface of the receptor 422 face each other, and the additional terminals 343 and 344 and the additional terminals 443 and 444 at both sides of the facing surfaces are respectively in contact with each other. The additional terminals 443 and 444 are pressed against the additional terminals 343 and 344, and the repulsive force from the additional terminals 343 and 344 keeps the additional terminals 343 and 344 and the additional terminals 443 and 444 respectively in contact with each other.

In this way, the present invention may be applied to the B-plug 30 and the B-receptacle 40 with equal effect to the first embodiment.

In this embodiment, the additional terminals 341 to 344 are disposed on the inner and outer surfaces of the protrusion 321 of the B-plug 30. The additional terminals 441 and 442 are disposed on the outer surface of the protrusion 421, and the additional terminals 443 and 444 are disposed on the inner surface of the cavity 423. However, the present invention is not limited thereto, and the additional terminals may be disposed to be exposed at the end surface of the protrusion 321 of the B-plug 30, and the additional terminals may be disposed to be exposed at the rear-end surface of the cavity 423 of the B-receptacle 40. In such a case, the end surface of the protrusion 321 and the rear-end surface of the cavity 423 are connect with each other when the B-plug 30 is inserted to the B-receptacle 40.

Third Embodiment

In the above first and second embodiments, exemplary structures of the connectors are described. In the third embodiment, the description is directed to a method for making correspondence between a plug and a receptacle to be connected to each other.

Figure 15A:
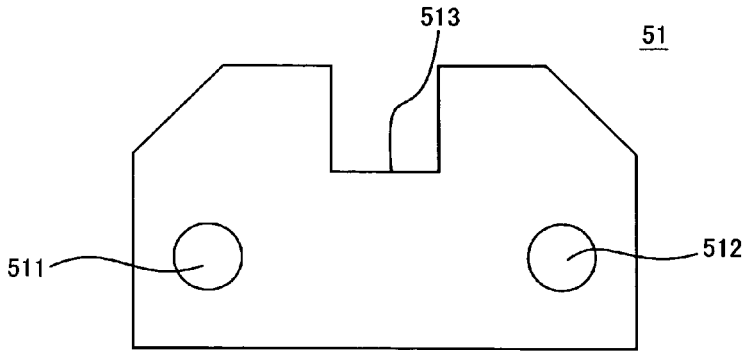
FIG. 15A is a pattern diagram of another exemplary B-receptacle according to an embodiment of the present invention.
Figure 15B:
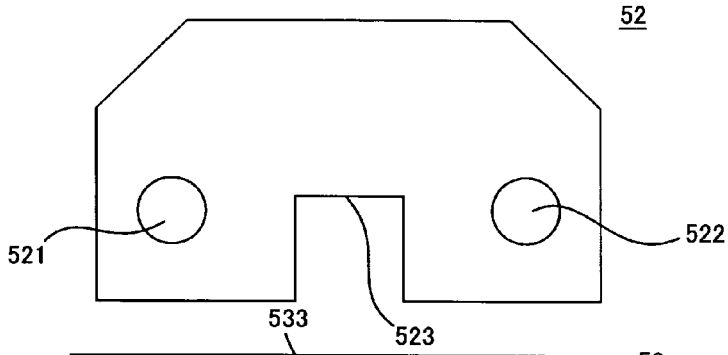
FIG. 15B is a pattern diagram of another exemplary B-receptacle according to an embodiment of the present invention.
Figure 15C:
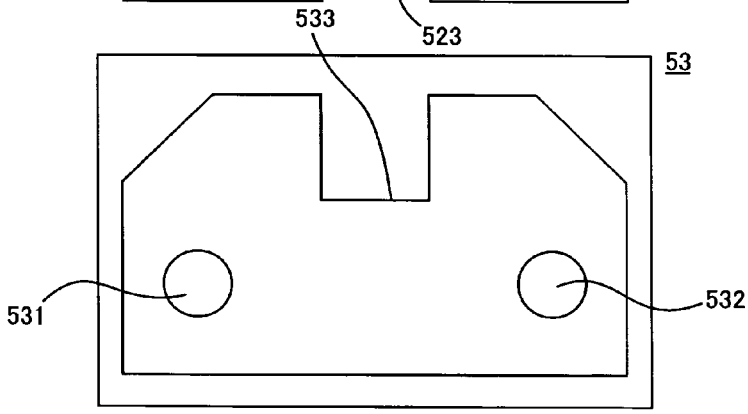
FIG. 15C is a pattern diagram of another exemplary B-receptacle according to an embodiment of the present invention.
Figure 15D:
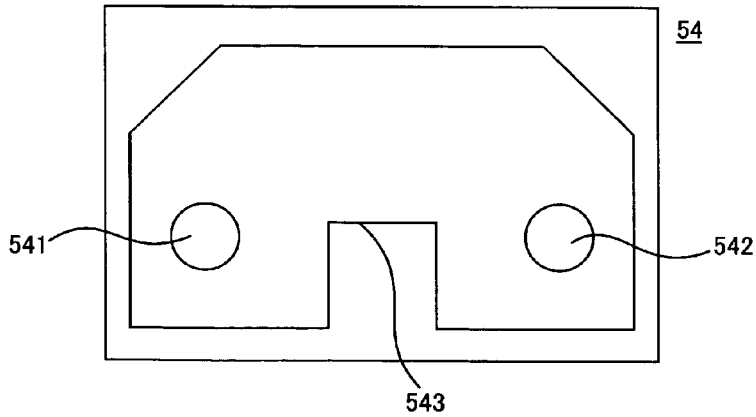
FIG. 15D is a pattern diagram of another exemplary B-receptacle according to an embodiment of the present invention.
Figure 16:
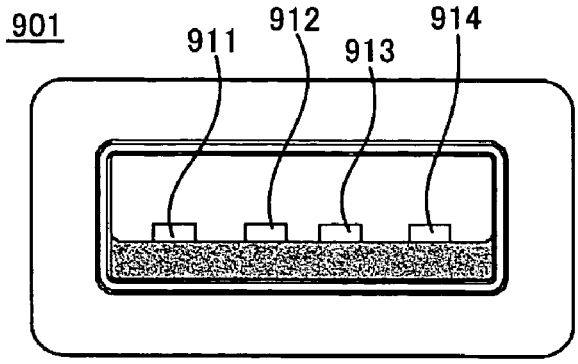
Fig. 16 Related Art
FIG. 16 is a front view of a conventional A-plug connector according to a related art.
Figure 17:
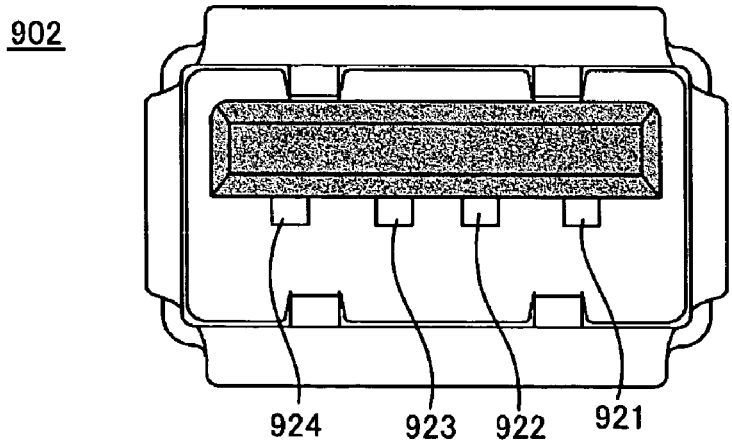
FIG. 17 is a front view of a conventional A-receptacle connector according to a related art.
Figure 18:
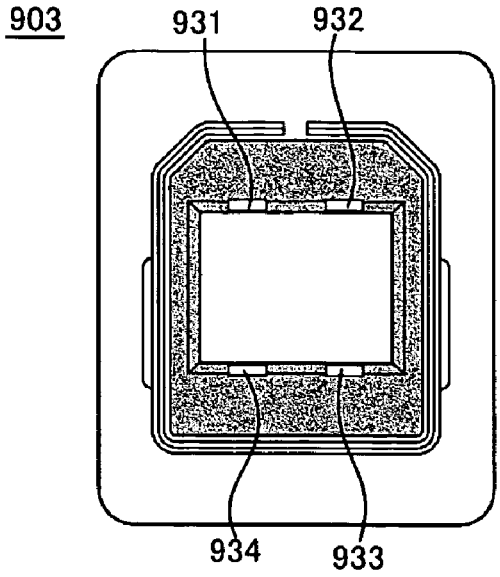
Fig. 18 Related Art
FIG. 18 is a front view of a conventional B-plug connector according to a related art.
Figure 19:
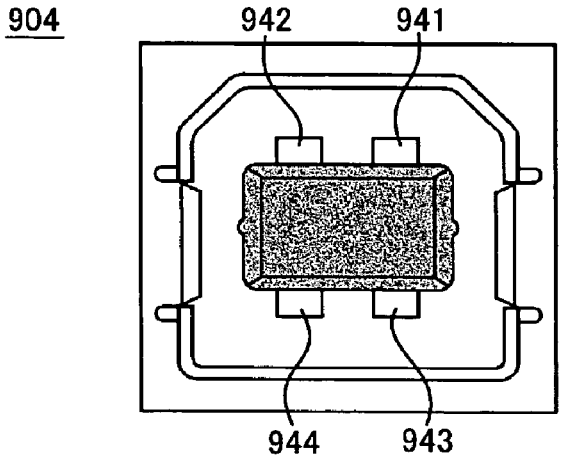
FIG. 19 is a front view of a conventional B-receptacle connector according to a related art.

FIGS. 15A to 15D schematically show a B-plug and a B-receptacle according to this embodiment. FIGS. 15A and 15B illustrate a B-receptacle, and FIGS. 15C and 15D illustrate a B-plug.

A B-receptacle 51 shown in FIG. 15A has additional signal terminals 511 and 512 on left and right. The B-receptacle 51 also has a recessed portion 513 at the top. A B-receptacle 52 shown in FIG. 15B has additional power supply terminals 521 and 522 on left and right. The B-receptacle 52 also has a recessed portion 523 at the bottom.

AB-plug 53 shown in FIG. 15C has additional signal terminals 531 and 532 on left and right. The B-plug 53 also has a raised portion 533 at the top. The raised portion 533 can penetrate through the recessed portion 513, and therefore the B-receptacle 51 can fit into the B-plug 53. On the other hand, the B-receptacle 52 cannot fit into the B-plug 53 because of the raised portion 533.

A B-plug 54 shown in FIG. 15D has additional power supply terminals 541 and 542 on left and right. The B-plug 54 also has a raised portion 543 at the bottom. The raised portion 543 can penetrate through the recessed portion 523, and therefore the B-receptacle 52 can fit into the B-plug 54. On the other hand, the B-receptacle 51 cannot fit into the B-plug 54 because of the raised portion 543.

In this way, by changing the outer shape of the B-receptacles 51 and 52 depending on whether the additional terminals are signal terminals or power supply terminals, it is possible to ensure correspondence between the B-receptacles 51 and 52 and the B-plugs 53 and 54, respectively, and prevent the wrong fitting between non-corresponding B-receptacle and B-plug. It is thereby possible to avoid that an additional signal terminal and a power supply terminal are connected accidentally. This ensures prevention of short-circuit which occurs due to a contact between a signal terminal and a power supply terminal.

It is apparent that the present invention is not limited to the above embodiment that may be modified and changed without departing from the scope and spirit of the invention.

What is claimed is:

1. A plug connector comprising:

a standard terminal provided on a first insulator surface in compliance with a standard of terminal configuration;

an additional terminal provided in association with a second insulator surface, and provided not in compliance with said standard, said second insulator surface being not in plane with said first insulator surface, said second insulator surface being not parallel with said first insulator surface; and a metal shield at least partially covering said standard terminal and said additional terminal, wherein said first insulator surface is a surface of a protrusion, said protrusion being formed on an inner surface of said metal shield and extending in a plug direction of said connector, wherein said second insulator surface is not parallel with said plug direction and is a surface of an insulation body formed on said protrusion, said additional terminal having a contact point thereof provided at said second insulator surface, said contact point being positioned to provide electrical connection with a corresponding contact point of a terminal of a receptacle connector when said plug and said receptacle connectors plugged with each other, and said body extending in said plug direction for a length smaller than a length of said protrusion along said plug direction.

2. The plug connector according to claim 1, wherein said standard is a USB standard.

3. The plug connector according to claim 1 further comprising:

another additional terminal formed on an outer surface of said protrusion different from said first and second insulator surfaces.

4. A receptacle connector comprising:

a standard terminal provided on a first insulator surface in compliance with a standard of terminal configuration;

an additional terminal provided in association with a second insulator surface, and provided not in compliance with said standard, said second insulator surface being not in plane with said first insulator surface, said second insulator surface being not parallel with said first insulator surface; and a metal shield at least partially covering said standard terminal and said additional terminal, wherein said first insulator surface is a surface of a protrusion, said protrusion being formed in a region surrounded by said metal shield and extending in a depth direction of said metal shield, wherein said second insulator surface is parallel with an aperture plane of said metal shield, and said second insulator surface is a surface of a receptor formed on said protrusion, and said second insulator surface exposes a contact point of said additional terminal, said contact point contacting with a corresponding contact point of a terminal of a plug connector, said receptor extending in said depth direction, a length of said receptor in said depth direction being shorter than that of said protrusion.

5. The receptacle connector according to claim 4, wherein said standard is a USB standard.

6. The receptacle connector according to claim 4, wherein said first insulator surface does not contact with said metal shield and said additional terminal is disposed on said second insulator surface.

7. The receptacle connector according to claim 6, further comprising:

another additional terminal disposed on an inner surface of said metal shield.

8. A plug connector comprising:

a first pair of terminals provided over a first insulating surface to transfer a voltage;

a second pair of terminals provided over a second insulating surface to transmit a signal;

an additional terminal provided in association with a third insulating surface independently of said first and second pairs of terminals, said third insulating surface being not in plane with said first and second insulating surfaces and being not parallel with said first and second insulating surfaces; and a metal shield covering said first and second pairs of terminals and said additional terminal, wherein said first insulating surface is a surface of a protrusion, said protrusion being formed on an inner surface of said metal shield and extending in a plug direction of said connector, wherein said third insulating surface is not parallel with said plug direction and is a surface of an insulation body formed on said protrusion, said additional terminal having a contact point thereof provided at said third insulating surface, said contact point being positioned to provide electrical connection with a corresponding contact point of a terminal of a receptacle connector when said plug and said receptacle connectors plugged with each other, and said body extending in said plug direction for a length smaller than a length of said protrusion along said plug direction.

9. The plug connector according to claim 8, wherein said second insulating surface is parallel with said first insulating surface and is not in plane with said first insulating surface.

10. The plug connector according to claim 8, wherein said additional terminal contacts in a depth direction of said metal shield with a terminal formed in a corresponding receptacle connector when said receptacle connector is fixed with said corresponding plug connector.

11. A receptacle connector comprising:

a first pair of terminals provided over a first insulating surface to supply a supply voltage;

a second pair of terminals provided over a second insulating surface to transmit a signal;

an additional terminal provided in association with a third insulating surface independently of said first and second pairs of terminals, said third insulating surface being not in plane with said first and second insulating surfaces and being not parallel with said first and second insulating surfaces; and a metal shield covering said first and second pairs of terminals and said additional terminal, wherein said first insulating surface is a surface of a protrusion, said protrusion being formed in a region surrounded by said metal shield and extending in a depth direction of said metal shield, wherein said third insulating surface is parallel with an aperture plane of said metal shield, and said third insulating surface is a surface of a receptor formed on said protrusion, and said third insulating surface exposes a contact point of said additional terminal, said contact point contacting with a corresponding contact point of a terminal of a plug connector, said receptor extending in said depth direction, a length of said receptor in said depth direction being shorter than that of said protrusion.

12. The receptacle connector according to claim 11, wherein said second insulating surface is parallel with said first insulating surface and is not in plane with said first insulating surface.

13. The receptacle connector according to claim 11, wherein said additional terminal contacts in a depth direction of said metal shield with a terminal formed in a corresponding plug connector when said receptacle connector is fixed with said corresponding plug connector.

* * * * *